US005303720A

United States Patent [19]

Banerjee et al.

[11] Patent Number: 5,303,720

[45] Date of Patent: Apr. 19, 1994

[54] SMOKING ARTICLE WITH IMPROVED INSULATING MATERIAL

[75] Inventors: Chandra K. Banerjee, Pfafftown, N.C.; Richard L. Lehman, Belle Mead, N.J.; William C. Squires; Rhonda F. Hayden, both of Winston-Salem, N.C.; Debra L. Raynor, Greensboro, N.C.

[73] Assignee: R. J. Reynolds Tobacco Company, Winston-Salem, N.C.

[21] Appl. No.: 883,030

[22] Filed: May 14, 1992

Related U.S. Application Data

[63] Continuation of Ser. No. 354,605, May 22, 1989, abandoned.

[51] Int. Cl.[5] ..... A24D 1/18

[52] U.S. Cl. ..... 131/194; 131/365

[58] Field of Search ..... 131/194, 195, 335, 365, 131/358; 162/3, 139, 145, 152

[56] References Cited

U.S. PATENT DOCUMENTS

| | | |
|---|---|---|
| 2,773,763 | 12/1956 | Scott et al. . |
| 2,967,118 | 1/1961 | Gary et al. . |
| 3,300,372 | 1/1967 | Bauer . |
| 3,379,608 | 4/1968 | Roberts et al. . |
| 4,079,742 | 3/1978 | Rainer et al. . |
| 4,153,503 | 5/1979 | Booth et al. . |
| 4,159,224 | 6/1979 | Cederquist et al. . |
| 4,346,028 | 8/1982 | Griffith . |
| 4,383,890 | 5/1983 | Oshima et al. . |
| 4,470,877 | 9/1984 | Johnstone et al. . |
| 4,609,433 | 9/1986 | Crutchfield et al. . |
| 4,714,082 | 12/1987 | Banerjee et al. . |
| 4,756,318 | 7/1988 | Clearman et al. . |

FOREIGN PATENT DOCUMENTS

| | | |
|---|---|---|
| 0942150 | 2/1974 | Canada . |
| 0174645 | 3/1986 | European Pat. Off. . |
| 2752367 | 6/1979 | Fed. Rep. of Germany . |
| 0212234 | 3/1987 | Fed. Rep. of Germany . |
| 0193600 | 11/1982 | Japan . |
| 61-101438 | 5/1986 | Japan . |
| 61258099 | 11/1992 | Japan . |

OTHER PUBLICATIONS

Ames et al. Mut. Res. 31: 347-364 (1975).

Nagao et al. Mut. Res. 42:335 (1977).

*Primary Examiner*—V. Millin

*Assistant Examiner*—J. Doyle

*Attorney, Agent, or Firm*—Grover M. Myers; David G. Conlin

[57] ABSTRACT

The present invention relates to an improved insulating sheet material and to cigarettes and other smoking articles which employ the insulating sheet material as one or more components thereof. The improved insulating material is particularly useful in smoking articles having a fuel element and a physically separate aerosol generating means, e.g. as an insulating member for insulating the fuel element. In general, the sheet material of the present invention is formable without the use of any organic binder and comprises an inorganic fibrous material such as calcium sulfate fibers, calcium sodium phosphate fibers, or mixtures thereof, and a relatively small amount of highly refined cellulose-based fibers such as wood pulp.

56 Claims, 1 Drawing Sheet

SMOKING ARTICLE WITH IMPROVED INSULATING MATERIAL

This is a continuation of copending application Ser. No. 07/354,605 filed on May 22, 1989 now abandoned.

BACKGROUND OF THE INVENTION

The present invention relates to an improved insulating sheet material and to cigarettes and other smoking articles which employ the insulating sheet material as one or more components thereof. The improved insulating material is particularly useful in smoking articles having a fuel element and a physically separate aerosol generating means, e.g. as an insulating member for insulating the fuel element. In general, the sheet material of the present invention is formable without the use of any organic binder and comprises an inorganic fibrous material such as calcium sulfate, calcium sodium phosphate, or mixtures thereof, and a relatively small amount of highly refined fibrillated cellulose-based fibers such as wood pulp.

Cigarettes, cigars and pipes are popular forms of tobacco smoking articles. Many smoking products and smoking articles have been proposed through the years as improvements upon, or as alternatives to, these popular forms of tobacco smoking articles, particularly cigarettes.

Many, for example, have proposed tobacco substitute smoking materials. See, e.g., U.S. Pat. No. 4,079,742 to Rainer et al. Two such materials, Cytrel and NSM, were introduced in Europe in the 1970's as partial tobacco replacements, but did not realize any long-term commercial success.

Many others gave proposed smoking articles, especially cigarette smoking articles, based on the generation of an aerosol or a vapor. See, for example, the background art cited in U.S. Pat. No. 4,714,082 to Banerjee et al.

Recently, in European Patent Publication Nos. 0174645 and 0212234, U.S. Pat. No. 4,714,082 to Banerjee et al. and U.S. Pat. No. 4,756,318 to Shannon et al., assigned to R. J. Reynolds Tobacco Co., there are described smoking articles, especially cigarette smoking articles, which are capable of providing the user with the pleasures associated with smoking, by heating but not burning tobacco and without delivering appreciable quantities of incomplete combustion or pyrolysis products. The improved insulating sheet material of the present invention is particularly suited for use with such articles.

Calcium sulfate, also commonly referred to as gypsum, has been used by artists and builders for thousands of years.

Recently, calcium sulfate has been produced in a fibrous form, primarily as a filler for reinforcement in thermoset and thermoplastic systems, such as polyesters, urethanes, epoxies, silicones, polypropylene, nylon, etc. In these systems calcium sulfate is used as a partial replacement for glass fibers and other reinforcing materials.

Another inorganic filler is calcium sodium phosphate. Like calcium sulfate, it too has been widely used in a variety of materials, primarily as a filler, such as for composites in organic polymeric materials. U.S. Pat. No. 4,346,028 to Griffith et al. discloses very thin, flexible calcium sodium phosphate fibers which are insoluble in water, and which are acid, alkali and temperature resistant. Described uses for such crystals/fibers include mats and felts, as reinforcing agents for cellulosic papers and fibers, as a substitute for asbestos in asbestos/cement mixtures, as an additive to oil-based and latex paints to change the drying properties of the paint, and to form laminates and composites with organic polymeric materials.

In U.S. Pat. No. 4,609,433 to Crutchfield et al., there is described the use of crystalline calcium M phosphate fibers as a replacement or substitute for asbestos in the manufacture of fibrous sheets. The sheet comprises the crystalline calcium M phosphate fibers (65–95% by weight), auxillary fibers such as wood pulp or synthetic fibers (1–15% by weight) having a Canadian freeness from about 300 ml to about 700 ml, and a water insoluble organic polymeric binder (5–30% by weight).

Japanese Patent Application Kokai No. 61-101438 describes a method of manufacturing gypsum paper with 50–96 parts by weight calcium sulfate, 2–20 parts by weight pulp, 2–30 parts by weight fibrous material, and 0.5–5 parts by weight fixing agent.

SUMMARY OF THE INVENTION

In general, the present invention relates to cigarettes and other smoking articles which employ an improved insulating sheet material and to the improved insulating sheet material itself. The sheet material of the present invention is particularly useful as an insulating member for smoking articles which have a fuel element and a physically separate aerosol generating means. In certain preferred embodiments, the sheet material is formed into a jacket which circumscribes or otherwise surrounds at least a portion of the fuel element of the smoking article. In general, the sheet material of the present invention is formable without the use of any organic binder and comprises, as a major component, an inorganic fibrous material such as calcium sulfate, calcium sodium phosphate, or mixtures thereof, and a relatively small amount of highly refined fibrillated cellulose-based fibers such as highly refined wood pulp.

In certain preferred embodiments there is added density reducing components such as carbonized or uncarbonized fibers including carbonized kapok, cotton, cotton linters, and the like. Alternatively, the density of the insulating sheet material can be reduced by foaming during processing. Other additive materials may also be added to improve, e.g., tensile and tear strength, ash integrity and permeability.

Preferably, the smoking articles which employ the improved insulating sheet material are cigarettes, which utilize a short, i.e., less than about 30 mm long, preferably carbonaceous, fuel element and which contain a roll of tobacco surrounding an aerosol generating means that is longitudinally disposed behind the fuel element. Preferably, the aerosol generating means is in a conductive heat exchange relationship with the fuel element. Tobacco also may be incorporated elsewhere in the article. The mouthend piece preferably comprises a filter segment, preferably one of relatively low efficiency, so as to avoid interfering with the mainstream aerosol produced by the aerosol generating means.

The insulating sheet material employed in the preferred smoking articles is preferably formed into a jacket from one or more layers of an insulating material as described below. Advantageously, this jacket is at least about 0.5 mm thick, preferably about 1 to about 2 mm thick. Preferably, the jacket extends over more than about half, if not all of the length of the fuel element. More preferably, it also extends over substantially the entire outer periphery of the fuel element and the capsule for the aerosol generating means. As shown in the embodiment of FIG. 1, different materials may be used to insulate these two components of the article.

The insulating sheet material of the present invention may also be utilized in other components of the smoking article. For example, it may be used to insulate all or part of the aerosol generating means or as a wrapper for all or a part of the smoking article. It may also be used as a carrier for aerosol forming materials and/or flavorants.

It has been found that the improved insulating sheet material of the present invention insulates the fuel source and/or aerosol generating portions of such cigarettes without producing any significant off-taste. It is believed that the off-taste associated with previously used insulating materials is due to the presence of organic binders such as pectin, sodium carboxy methylcellulose, Guar gum, and the like.

The preferred inorganic fibrous materials, calcium sulfate and calcium sodium phosphate, have substantially improved biodegradability as compared with other commonly used insulating fibers.

Moreover, the sheet material of the present invention has been found to have a surprisingly high tensile strength and tear strength, despite the fact that in certain preferred embodiments, the amount of fibrous material may be in excess of 55% by weight of the sheet material. In general, the sheet material also has good ash integrity when used as an insulator for the fuel source without interfering with mainstream aerosol produced by the cigarette. The sheet material also has a surprisingly low bending stiffness which is important in terms of machinability and handling.

As used herein, and only for the purposes of this application, "aerosol" is defined to include vapors, gases, particles, and the like, both visible and invisible, and especially those components perceived by the user to be "smoke-like," generated by action of the heat from the burning fuel element upon substances contained within the aerosol generating means, or elsewhere in the article.

As used herein, the term "carbonaceous" means primarily comprising carbon.

As used herein, the term "substantially free of organic binder" means that the amount of organic binder present in the material, other than cellulose-based fiber pulp, is less than 0.5% by weight.

Cigarettes and other smoking articles which employ the improved insulating sheet material in accordance with the present invention are described in greater detail in the accompanying drawings and the detailed description of the invention which follow.

DETAILED DESCRIPTION OF THE PREFERRED EMBODIMENTS

Figure 1:
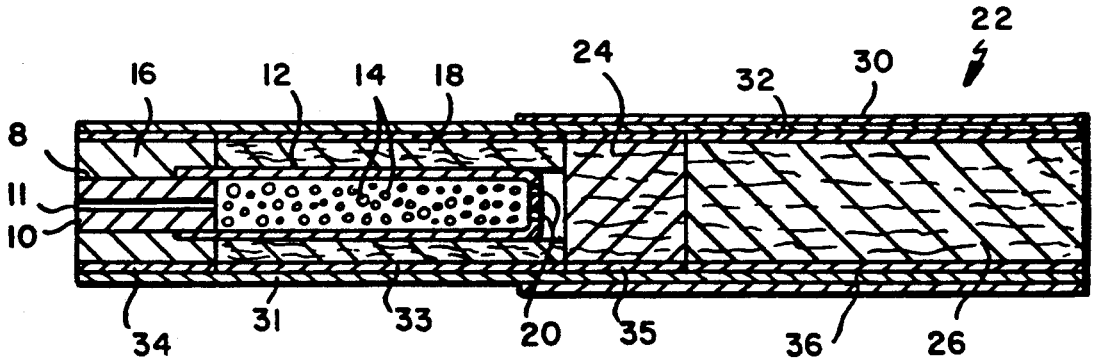
FIG. 1 is a longitudinal sectional view of one preferred cigarette employing the improved insulating sheet material in accordance with the present invention.

In accordance with the present invention, there is provided an improved insulating sheet material for use in smoking articles. The improved sheet material is particularly suited for insulating the fuel end of cigarettes and other smoking articles having a small combustible fuel element, a physically separate aerosol generating means, and a separate mouthend piece such as those described in the above-referenced EPO Publication Nos. 174,645 and 212,234, U.S. Pat. No. 4,714,082 to Banerjee et al. and U.S. Pat. No. 4,756,318 to Shannon et al., the disclosures of which are incorporated herein by reference.

In general, the improved insulating sheet material comprises an excess of an inorganic fibrous material such as calcium sulfate, calcium sodium phosphate, or mixtures thereof, and a substantially smaller amount of highly refined cellulose-based fibers such as wood, flax, cotton, hemp, jute, ramie, tobacco, and the like. The preferred cellulose-based fiber is highly refined wood pulp.

While a variety of inorganic fibrous materials such as calcium carbonate, glass fibers, alumina fibers (Saffil-alumina, Imperial Chemical Industries, Wilmington, Del.), and the like may be used in practicing the present invention, the preferred fibrous materials are calcium sulfate fibers, calcium sodium phosphate crystalline fibers or mixtures thereof.

The preferred calcium sulfate fibers are those produced by U.S. Gypsum (Franklin Fibers fibrous) under designation Nos. A-30, H-30, H-45, and P-1.

The preferred calcium sodium phosphate fiber is a crystalline substance called calcium sodium metaphosphate produced by Monsanto Company, St. Louis, Mo. and described in the above referenced U.S. Patent to Griffith et al.

Preferred inorganic fibrous material used in practicing the present invention have a number average fiber length of less than about 1 mm, preferably less than about 500u, most preferably less than about 250u, as do the preferred calcium sodium phosphate fibers and calcium sulfate fibers.

The amount of inorganic fibrous material by weight percent of the insulating sheet material may range broadly depending on a number of factors including the desired basis weight (density), tensile and tear strength, permeability, thermal stability, ash integrity, insulating properties, and the like. In general, the amount of fibrous material is greater than about 55%. Preferably, it is greater than about 70%. Most preferably, it is greater than about 90%.

While in certain preferred embodiments the preferred fibrous material is calcium sulfate or calcium sodium metaphosphate, these preferred materials may be used in conjunction with other fibrous materials such as those described above. The amount of the preferred fibrous material, when used in conjunction with other fibrous material, should be greater than about 30% by weight of the insulating sheet material, preferably greater than about 45%, most preferably greater than about 60%.

The preferred cellulose-based pulp component of the improved insulating sheet material may be any of a variety of materials including hardwood or softwood pulp, or any of the commonly used wood pulps used in papermaking processes. Other cellulose-based pulps include cotton, hemp, jute, ramie, tobacco, or mixtures thereof.

Preferably, the pulp component of the sheet material is a highly refined fibrillated pulp prepared by, for example, processing the pulp in a Valley Beater or a disc refiner to obtain a fibrillated pulp with a Canadian Freeness of less than about 500, preferably less than about 300, and most preferably less than about 100. The preferred pulp is Northern Softwood pulp (Buckeye Cellulose Corp., Memphis, Tenn.). Preferably, this pulp is refined in a disc refiner with dulled blades to a Canadian Freeness of less than about 100. Canadian Standard Freeness is determined by TAPPI method T-227 Freeness of Pulp. The length of such refined fibers is generally between about 0.5 and 4 mm, with a number average fiber length of about 0.7 mm.

It is believed that fibrillation of the pulp component of the sheet material mechanically binds the fibrous material into the form of a sheet. As noted above, the preferred sheet material is substantially free of organic binders which are commonly used in papermaking processes. While such organic binders may be used in practicing the present invention, the mechanical interlocking of fibrils obtained in accordance with the present invention obviate the need for such organic binders. The preferred sheet material generally has less than about 3% by weight solubilized organic binders, preferably less than about 1%, and most preferably less than about 0.1%.

Fibrillation of the pulp may be achieved in any number of ways as will be appreciated by those skilled in the art. On a laboratory scale, fibrillated pulp may be prepared by, for example, beating in a PFI Mill at 20–30K for about 10–30 minutes. Scale-up of this process may be achieved by using a disc refiner with blades which have been dulled to simulate beating as opposed to cutting of the pulp.

The amount of refined wood pulp will in general vary inversely with the amount of fibrous material used in the insulating material. It is generally less than about 45%., preferably, less than about 30%, and most preferably, less than about 10%.

The overall thickness of the insulating sheet material will depend primarily on its use. When used as an insulating material for the preferred cigarettes, the thickness will generally be at least about 0.5 mm thick, preferably at least about 1.0 mm thick, and most preferably between about 1.5 to 2.0 mm thick.

As noted above, the insulating sheet material may be made using conventional papermaking techniques with certain modifications thereto for certain preferred embodiments. In general, fibrillated wood pulp having the appropriate Canadian Freeness is added to warm (about 50° C.) water and thoroughly mixed. The fibrous material is added to the above slurry and again thoroughly mixed. Any density reducing component is preferably added at this time. This mixture is poured into a sheet-making mold generally having a 100 mesh (U.S.) screen containing warm (50° C.) water. The slurry-containing mold is gravity drained and the sheet is transferred to a conventional flat-bed dryer which has been preset at about 200° C. and dried until the moisture content is less than about 2%. It is preferred to avoid any undue pressing of the sheet during processing to help to obtain desired lower densities of the finished sheet material.

The sheet material is thereafter preferably formed into a jacket by cutting it into 24.5 mm strips followed by grooving to make the sheet more flexible. Grooving of the sheet material may be on either or both of the surfaces. Alternatively, the sheet material can be shredded or sat and then wrapped or otherwise formed into a jacket which circumscribes the fuel element. Grooving is preferred.

Grooving is generally in the shape of a "V" on the inner surface so that the material can be easily formed around the fuel element. Grooving can be on either of the surfaces. This helps to reduce the weight of the smoking article and provides a measure of control over the permeability and bypass of the article.

Grooves may be provided by a number of techniques as the skilled artisan will appreciate. In general, the grooving angle can range between about 30° and 60°, preferably between 45° and 55°, most preferably about 50°. One preferred means for providing grooves is a milling machine having a modified head. The modified head preferably has multiple cutter blades with adjustable spacing to provide the required depth and angle. One such preferred blade comprises eight blades spaced and angled to provide a groove having a 50° angle and an ungrooved base depth sufficient to maintain the integrity of the sheet material during handling, typically about 15 to 20 mils. Preferably, the sheet is held in place during the grooving operation on a vacuum table to help provide uniform grooves.

For the preferred smoking articles, the grooved sheet material is preferably formed into the insulating jacket by the method described in U.S. Ser. No. 097,240, filed Sep. 15, 1987, the disclosure of which is hereby incorporated by reference. Using such a method, the sheet material is preferably grooved on-line prior to feeding the sheet material into apparatus described therein.

In certain preferred embodiments, the insulating sheet material will also have one or more density reducing components such as carbonized or uncarbonized fibers such as kapok, cotton, cotton linters, tobacco, cork, and the like, as well as other materials including graphite fibers, vermiculite, mica and hollow glass spheres. The preferred density reducing component is a burnable carbonized fiber selected from the group of carbonized kapok, cotton, cotton linters, jute or mixtures thereof. Other such materials which reduce density or increase strength can also be used as will be apparent to the skilled artisan.

The amount of carbonized fibers or other density reducing component used will depend on a number of factors including the desired reduction in density, as well as the desired permeability and strength of the insulating sheet material. For cigarettes described in the aforementioned European Patent Publication Nos. 0174645 and 0212234 and U.S. Pat. Nos. 4,714,082 and 4,756,318, the density of the sheet material is generally less than about 0.5 g/cc, preferably less than about 0.3 g/cc, and most preferably less than about 0.25 g/cc. By way of example, for sheet material containing about 80% calcium sulfate, if the desired density is 0.3 g/cc, then the amount of carbonized kapok fibers by weight per cent should normally be about 10%. If a decrease in density is desired, for example from 0.3 to 0.2 g/cc, then the amount of carbonized kapok fibers can be increased to about 20% to achieve that desired density.

While the carbonized fibers may be prepared in a number of ways, one preferred process includes the steps of a) fluffing and cleaning the fibers; b) forming a mat of uniform density (,e.g. about 3 to 5 pounds per cubic foot in a batch furnace, or 0.2 to 0.8 pounds per cubic foot in a continuous furnace); and c) carbonizing in an inert atmosphere ($N_2$) at 300–900° C., preferably at 550–750° C. for about one hour.

In certain other preferred embodiments, the density of the sheet material may be reduced without the use of high bulk filler materials described above. Specifically, the density of the sheet material can be reduced by a foaming procedure whereby air bubbles are trapped inside the sheet material. One procedure for introducing air bubbles into the sheet material includes the following steps. Glass fibers are agitated with a dilute (0.003%) aqueous solution of a dispersant in a high speed blender. Dispersants which may be used include Katapol (GAF), octoxynol (Triton-X), sodium lauryl sulfate, polyoxyethylene sorbitan monooleate and mono and di-glycerides of fats and oils. The preferred dispersant is Katapol. The cellulose-based fiber pulp is added along with a foam stabilizer, such as carboxymethl-cellulose, methyl-cellulose, hydroxypropyl methyl-cellulose, and the like. One preferred foam stabilizer is Methocel (Dow Chemicals). This suspension is agitated at high speed while forcing high pressure air through the solution at the same time. The inorganic fibrous material is added to the foamed suspension and formed into a sheet as discussed below. The size and concentration of the air bubbles trapped in the sheet depend on a number of factors including the concentration of foam stabilizer, the concentration of dispersant, the amount of agitation and amount of aeration. Foaming the insulating sheet material results in a density reduction of from about 0.42 g/cc (for the unfoamed sheet material) to about 0.22 g/cc.

There may also be included in the composition certain additives which help to increase the "ash integrity." As used herein "ash integrity" is a relative term used to indicate the strength of ash as compared with a control sheet material. More specifically, ash integrity is measured in either of two ways. For the sheet material itself, ash integrity is measured by placing a predetermined length of the sheet material in a muffle furnace at 700° C. on a raised support for 15 minutes. The amount of ash retained on the support is an indication of the ash integrity of the sheet. Ash integrity of smoking articles employing the sheet material as an insulator for the fuel element is determined by dropping the article after smoking from a predetermined height and measuring the amount of fallen ash. As the skilled artisan will appreciate, this measurement may be made by determining the number of drops required to obtain a certain amount of ash or by the amount of ash per drop.

Additives which help to increase the ash integrity include certain glassy sodium polyphosphates, such as Glass "H" (FMC Corp., Philadelphia, Pa.), sodium silicate, sodium carbonate, graphite and licorice which also serves as a flavorant. The amount of additive used will depend on a number of factors including the amount of cellulosic fiber material, the aspect ratio of the fibers in the cellulose-based fibers, the form of the fiber, the extent of hydration of the inorganic fibrous material and desired strength of the ash. For example, an increase in the amount of wood pulp decreases the ash integrity, while an increase in the aspect ratio of the inorganic fibrous material used increases the ash integrity. In general, the amount of additive by weight percent is between about 10% and 0.1%, preferably between about 5%.and 0.5%, and most preferably between about 2% and 1%.

Other additives may be included to increase the retention of the inorganic fibrous material. For example, when the inorganic fibrous material is calcium sulfate fibers, it has been found that dopants such as calcium hydroxide, calcium acetate, calcium carbonate, calcium sulfate, or mixtures thereof (i.e., calcium ion containing compounds) help to retain the calcium sulfate fibers during processing. Other dopants which help retain the calcium sulfate fibers include sodium alginate, magnesium carbonate and dolomite. Without wishing to be bound by theory, it is believed that the dopant decreases the solubility of the calcium sulfate fiber. In addition, it is believed that the dopant accelerates the setting up of the calcium sulfate fibers in the sheet forming process.

The amount of dopant used will depend on a number of factors including the inorganic fibrous and cellulose-based pulp material used, the sheet forming process employed and the temperature of the water used in processing the sheet material. For example when calcium sulfate fibers are used, the amount of dopant may be up to about 0.8% by weight of the sheet material, preferably between about 0.4 to 0.6%, and most preferably about 0.5%.

In order to maximize retention of the inorganic fibrous material during processing, the dopant should be added prior to addition of the cellulose-based fiber pulp, e.g., by adding it to the warm water used to disperse the cellulosed-based fiber pulp.

The tensile and tear strength of the insulating sheet material should be sufficient to prevent the sheet from tearing, or otherwise breaking during normal handling and machinabilty. In general, for a sheet having a thickness of about 40 mils, the tensile strength as determined by TAPPI T 494 OM-81 should be greater than about 2 lbs/in., preferably greater than about 5 lbs/in., and most preferably greater than about 8 lbs/in. The tear strength (for a sheet having a thickness of about 40 mils) as determined by TAPPI T 414 OM-82 should be greater than about 500 millinewtons (mN), preferably greater than about 500 mN, and most preferably greater than about 800 mN. Tensile and tear strength can be increased by changing the amount and type of cellulosic fiber, the amount of refining thereof and the amount of other additives used.

The bending stiffness of the insulating sheet material may range broadly. In general, for a sheet having a thickness of about 40 mils, the bending stiffness, as measured by an L & W stiffness tester (Scanpro Instr. Co., Fairfield, N.J.) should be between about 50 to 2000 mN, preferably between about 100 to 1200 mN, and most preferably between 150 and 500 mN.

The thermal conductivity of the sheet material is important as a function of how well a given sheet material insulates or otherwise conducts heat. For the preferred cigarettes where the sheet material is used to circumscribe or otherwise surround the fuel element, the thermal conductivity in Cal/(sec-cm-°C.) should be less than about 0.002, preferably less than about 0.001, and most preferably less than about 0.0005. The thermal conductivity may be increased or decreased by changing the type and amount of fibrous material used and/or by changing the density of the sheet material.

While the permeability of the insulating sheet material may vary over a broad range, it generally has a permeability as determined by a Fairchild Permeability Tester (Model No. PT-2) between about 500 and 5000 cm/sec, preferably between 1000 and 3000 cm/sec, and most preferably about 2500. The permeability of the sheet material depends on a number of factors including the amount and aspect ratio of the density reducing fibers and the freeness of the pulp. Permeability may also be changed by providing grooves or holes by mechanical, electrostatic or laser means, and/or by slitting of the sheet material. Sheet materials having a permeability in the preferred range help sustain burning of the fuel element.

Flavorants may be incorporated into or onto the insulating sheet material in any of a number of ways such as spraying, dipping, printing, vapor deposition and the like. Preferably, the flavorant is applied to the sheet by a vapor deposition technique. Vapor deposition is a technique which typically comprises warming the flavorant to a point where it is highly volatile and passing or contacting the insulating sheet material with the vapors for a period sufficient to allow the desired quantity of flavorant to be absorbed/adsorbed onto the insulating sheet material.

Still other methods of applying flavorants to the carbon either before or after it is incorporated into the sheet material will be readily apparent to the skilled artisan.

Any number of flavorants may be used in practicing the present invention such as licorice, menthol, vanillin, artificial coffee, tobacco extracts, liquors, cocoa butter, and other agents which impart flavor to the aerosol produced by the smoking article. Other flavorants which may be employed includes those listed in Leffingwell et al., "Tobacco Flavorings for Smoking Products", R. J. Reynolds Tobacco Company, Winston-Salem, N.C. (1972).

The amount of flavorant impregnated or otherwise carried by the sheet material may vary over a broad range. In preferred smoking articles, such as those described in Example I, the amount of flavorant such as licorice incorporated into the insulating sheet material is between about 0.5 to 2%, most preferably about 1%.

As noted above, in certain preferred embodiments the insulating sheet material circumscribes or otherwise surrounds at least a portion of the fuel element. This sheet material may be formed into a jacket by conventional techniques. Preferably, the sheet material is grooved in the shape of a "V" having an angle of about 50° to leave an ungrooved base depth between about 15 to 20 mils.

In preferred embodiments in which the insulating sheet material surrounds the fuel element, the length of the sheet material will, in general, coincide or be slightly greater than the length of the fuel element. For cigarettes employing the preferred fuel element described in Example I, infra, the length of the jacket of sheet material is generally about 10 mm in length.

From a performance and/or aesthetic standpoint the firmness of the insulating sheet material employed in accordance with the present invention may vary broadly without substantially interfering with delivery of aerosol to the user. However, it is desirable to have a sheet material which when used to jacket the fuel element feels and has about the normal firmness of a cigarette.

The overall pressure drop of smoking articles employing the improved insulating sheet material in accordance with the present invention is preferably similar to or less than that of other cigarettes. The pressure drop of the fuel end of smoking articles employing the insulating sheet material will vary in accordance with the number and/or-depth of the grooves as well as the density of the sheet material. For preferred smoking articles, such as those described in Example I, infra, the pressure drop will generally be in the range of about 200 to 50 mm water, preferably in the range of from about 150 to about 75 mm water, and most preferably in the range of from about 120 to about 80 mm water.

Figure 2:
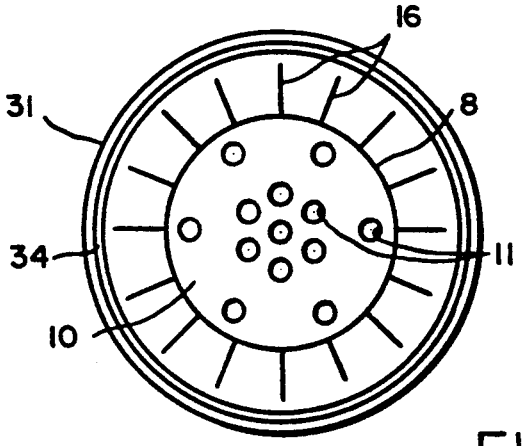
FIG. 2 illustrates, from the lighting end, a preferred fuel element circumscribed by a grooved insulating sheet material.

One such preferred cigarette is illustrated in FIG. 1 accompanying this specification. Referring to FIG. 1, there is illustrated a cigarette having a small carbonaceous fuel element 10 with a plurality of passageways 11 therethrough, preferably about thirteen arranged as shown in FIG. 2. Another preferred embodiment employs a fuel element having eleven holes similar to the arrangement in FIG. 2, but with only five central passageways formed in an "X" pattern. This fuel element is shown surrounded by insulating sheet material 16 having a plurality of grooves which facilitate formation of the sheet material into a jacket surrounding fuel element 10.

The fuel element is formed from an extruded mixture of carbon (preferably from carbonized paper), sodium carboxymethyl cellulose (SCMC) binder, $K_2CO_3$, and water, as described in greater detail below as well as in the above referenced patent applications and EPO publications.

A metallic capsule 12 overlaps a portion of the mouthend of the fuel element 10 and encloses the physically separate aerosol generating means which contains a substrate material 14 which carries one or more aerosol forming materials. The substrate may be in particulate form, in the form of a rod, or in other forms as detailed in the above referenced patent applications.

Capsule 12 is circumscribed by a roll of tobacco 18. Alternatively, in other smoking articles, the capsule may be circumscribed with an additional or continuous jacket of the improved insulating sheet material of the present invention. Two slit-like passageways 20 are provided at the mouth end of the capsule in the center of the crimped tube.

At the mouth end of tobacco roll 18 is a mouthend piece 22, preferably comprising a cylindrical segment of a flavored carbon filled sheet material 24 and a segment of non-woven thermoplastic fibers 26 through which the aerosol passes to the user. The article, or portions thereof, is overwrapped with one or more layers of cigarette papers 30–36.

As noted above, the improved insulating sheet material may be located in one or more of the other components of the smoking article, including within the aerosol generating means and the separate delivery means. For example, the insulating sheet material can be used to circumscribe all or a portion of the aerosol generating means. In fact, the sheet material itself may also be used for a variety of non-cigarette applications, e.g., as a substitute for fiberglass insulating material, as will be appreciated by the skilled artisan.

Upon lighting the aforesaid cigarette, the fuel element burns, generating the heat used to volatilize the tobacco flavor material and any additional aerosol forming substance or substances in the aerosol generating means and the tobacco roll. During lighting and in the first few puffs, the cellulose-based fiber quickly burns out leaving behind the inorganic fibrous component of the sheet material. This burn-out reduces the weight of the sheet material which reduces the heat-sink effect, thus directing more energy to the aerosol generating means. There is also a resulting increase in the permeability of the sheet material which helps to maintain burning of the fuel over the life of the article. Burn-out of the cellulose-based pulp as well as other burnable components of the sheet material also leaves behind air pockets which helps to insulate the burning fuel element.

Preferred smoking articles employing the improved insulating sheet material in accordance with the present invention are capable of providing at least 0.6 mg of mainstream aerosol, measured as wet total particulate matter (WTPM), in the first 3 puffs, when smoked under FTC smoking conditions, which consist of 35 ml puffs of two seconds duration, separated by 58 seconds of smolder. More preferably, embodiments of the invention are capable of providing 1.5 mg or more of aerosol in the first 3 puffs. Most preferably, embodiments of the invention are capable of providing 3 mg or more of aerosol in the first 3 puffs when smoked under FTC smoking conditions. Moreover, preferred embodiments of the invention provide an average of at least about 0.8 mg of WTPM per puff for at least about 6 puffs, preferably at least about 10 puffs, under FTC smoking conditions.

In addition to the aforementioned benefits, preferred smoking articles of the present invention are capable of providing an aerosol which is chemically simple, consisting essentially of air, oxides of carbon, water, the aerosol former, any desired flavors or other desired volatile materials, and trace amounts of other materials. The aerosol preferably also has no significant mutagenic activity as measured by the Ames Test.

The aerosol produced by the preferred smoking articles of the present invention is chemically simple, consisting essentially of air, oxides of carbon, aerosol former including any desired flavors or other desired volatile materials, water and trace amounts of other materials. The WTPM produced by the preferred articles of this invention has no mutagenic activity as measured by the Ames Test, i.e., there is no significant dose response relationship between the WTPM produced by preferred smoking articles of the present invention and the number of revertants occurring in standard test microorganisms exposed to such products. According to the proponents of the Ames Test, a significant dose dependent response indicates the presence of mutagenic materials in the products tested. See Ames et al., *Mut. Res.*, 31: 347-364 (1975); Nagao et al., *Mut. Res.*, 42: 335 (1977).

The use of the improved insulating sheet material of the present invention in cigarettes will be further illustrated with reference to the following examples which will aid in the understanding of the present invention, but which are not to be construed as a limitation thereof. All percentages reported herein, unless otherwise specified, are percent by weight. All temperatures are expressed in degrees Celsius and are uncorrected.

EXAMPLE I

A cigarette of the type illustrated in FIG. 1 was made in the following manner.

A. Fuel Source Preparation

The fuel element (10 mm long, 4.5 mm o.d.) having an apparent (bulk) density of about 0.86 g/cc, was prepared from hardwood pulp carbon (80 weight percent), Raven i lampblack carbon (unactivated, 0.02 um, 10 weight percent), SCMC binder (10 wt. percent) and $K_2CO_3$ (1 weight percent).

The hardwood pulp carbon was prepared by carbonizing a non-talc containing grade of Grand Prairie Canadian Kraft hardwood paper under a nitrogen blanket, at a step-wise increasing temperature rate of about 10° C. per hour to a final carbonizing temperature of 750° C.

After cooling under nitrogen to less than about 35° C., the paper carbon was ground to a mesh size of minus 200 (U.S.). The powdered carbon was then heated to a temperature of up to about 850° C. to remove volatiles.

After again cooling under nitrogen to less than about 35° C., the paper carbon was ground to a fine powder, i.e., a powder having an average particle size of from about 0.1 to 50 microns.

This fine paper carbon powder was admixed with the lampblack carbon, Hercules 7HF SCMC binder and $K_2CO_3$in the weight ratios set forth above, together with sufficient water to make a stiff, dough-like paste.

Fuel elements were extruded from this paste having seven central holes each about 0.021 in. in diameter and six peripheral holes each about 0.01 in. in diameter. The web thickness or spacing between the central holes was about 0.008 in. and the average outer web thickness (the spacing between the periphery and peripheral holes) was 0.019 in. as shown in FIG. 1A.

These fuel elements were then baked-out under a nitrogen atmosphere at 900° C. for three hours after formation.

B. Spray Dried Extract

A blend of flue cured tobaccos were ground to a medium dust and extracted with water in a stainless steel tank at a concentration of from about 1 to 1.5 pounds tobacco per gallon water. The extraction was conducted at ambient temperature using mechanical agitation for from about 1 hour to about 3 hours. The admixture was centrifuged to remove suspended solids and the aqueous extract was spray dried by continuously pumping the aqueous solution to a conventional spray dryer, an Anhydro Size No. 1, at an inlet temperature of from about 215°-230° C. and collecting the dried powder material at the outlet of the drier. The outlet temperature varied from about 82°-90° C.

C. Preparation of Sintered Alumina

High surface area alumina (surface area of about 280 $m^2/g$) from W. R. Grace & Co., having a mesh size of from −14 to +20 (U.S.) was sintered at a soak temperature of about 1400° C. to 1550° C. for about one hour, washed with water and dried. This sintered alumina was combined, in a two step process, with the ingredients shown in Table I in the indicated proportions:

TABLE I

| | |
|---|---|
| Alumina | 68.11% |
| Glycerin | 19.50% |
| Spray Dried Extract | 8.19% |
| HFCS (Invertose) | 3.60% |
| Abstract of Cocoa | 0.60% |
| Total: | 100.0% |

In the first step, the spray dried tobacco extract was mixed with sufficient water to form a slurry. This slurry was then applied to the alumina carrier described above by mixing until the slurry was uniformly absorbed by the alumina. The treated alumina was then dried to reduce the moisture content to about 1 weight percent. In the second step, this treated alumina was mixed with a combination of the other listed ingredients until the liquid was substantially absorbed within the alumina carrier.

D. Assembly

The capsule used to construct the FIG. 1 cigarette was prepared from deep drawn aluminum. The capsule had an average wall thickness of about 0.004 in. (0.1 mm), and was about 30 mm in length, having an outer diameter of about 4.5 mm. The rear of the container was sealed with the exception of two slot-like openings (each about 0.65×3.45 mm, spaced about 1.14 mm apart) to allow passage of the aerosol former to the user.

About 330 mg of the aerosol producing substrate described above was used to load the capsule. A fuel element prepared as above, was inserted into the open end of the filled capsule to a depth of about 3 mm.

E. Insulating Jacket

The fuel element-capsule combination was overwrapped at the fuel element end with a 10 mm long, insulating jacket formed from a grooved sheet material and prepared as follows:

1.6 grams of refined wood pulp having a Canadian Freeness of 100 was added to 500 ml of warm (50° C.) water and blended for one minute at high speed in a household-type Osterizer blender. 11.2 grams of anhydrous calcium sulfate (a Franklin Fiber from U.S. Gypsum designated P-1) was added to the above slurry and blended at low speed for about 30 seconds. 3.2 grams of carbonized Kapok fibers (carbonized at 650° C. for one hour under an $N_2$ atmosphere) were added and blended at low speed for 10 seconds. This mixture was poured into 8" by 8" mold having a 100 mesh (U.S.) screen containing 3 liters of warm (50° C.) water. The slurry-containing mold was gravity drained and the sheet was transferred to a conventional flat-bed dryer which had been preset at 200° C. and dried until the moisture content was less than about 1%. This sheet had a thickness of about 1.5 mm, a density of about 0.18 g/cc, and a permeability of about 1500 cm $sec^{-1}$. A parallel set of smoking articles were also prepared using both cotton and cotton linters as the density reducing agents. The sheet materials had respective densities of 0.23 and 0.28 g/cc. The sheet material was formed into a jacket by cutting it into 24.5 mm strips which were grooved with a plurality of "V" shaped grooves with an angle of 50° and an ungrooved base depth of about 18 mils to make the sheet more flexible.

The insulating jacket was then wrapped with an innerwrap material, a Kimberly-Clark experimental paper designated P780-63-5.

F. Tobacco Roll

A 7.5 mm diameter tobacco roll (28 mm long) with an overwrap of Kimberly-Clark's P1487-125 paper was modified by insertion of a probe to have a longitudinal passageway of about 4.5 mm diameter therein.

G. Assembly

The jacketed fuel element-capsule combination was inserted into the tobacco roll passageway until the jacket of insulating material abutted the tobacco. The jacket of insulating material and tobacco sections were joined together by an outerwrap material which circumscribed both the fuel element/insulating jacket/innerwrap combination and the wrapped tobacco roll. The outerwrap was a Kimberly-Clark paper designated P1768-182.

H. Mouthend Piece Assembly

A mouthend piece of the type illustrated in FIG. 1, was constructed by combining two sections: (1) a 10 mm long, 7.5 mm diameter carbon filled tobacco sheet material adjacent the capsule, overwrapped with Kimberly-Clark's P850-184-2 paper and (2) a 30 mm long, 7.5 mm diameter cylindrical segment of a non-woven melt-blown thermoplastic polypropylene web obtained from Kimberly-Clark Corporation, designated P-100-F, overwrapped with Kimberly-Clark's P1487-184-2 paper.

The carbon-filled tobacco sheet material was prepared by incorporating about 17% of PCG-G activated carbon from Calgon Corporation into a paper furnish used to make a sheet material obtained from Kimberly-Clark designated P144-185-GAPF.

These two sections were combined with a combining overwrap of Kimberly-Clark's P850-186-2 paper.

I. Final Assembly

The combined mouthend piece section was joined to the jacketed fuel element-capsule section by a final overwrap of Ecusta's 30637-801-12001 tipping paper.

Cigarettes thus prepared produced an aerosol resembling tobacco smoke without any undesirable off-taste due to binders present in previous insulating materials and without any scorching or thermal decomposition of the aerosol forming material.

EXAMPLE II

Smoking Articles similar to those described in Example I were constructed except that Glass "H" and licorice were added to the sheet material as follows:

After the sheet was removed from the mold, it was sprayed with a 10% solution of Glass "H" to a final concentration of 1% by weight percent of the sheet. The sheet was then dried as above and thereafter sprayed with a 10% licorice solution, again to a final concentration of 1% by weight percent of the sheet material. The dried sheet material was formed into an insulating jacket substantially as described above.

Smoking articles employing this insulating jacket had improved ash integrity and a pleasant flavor during smoking.

EXAMPLE III

Smoking articles similar to those described in Example I were prepared, except the insulating sheet material was prepared using calcium sodium metaphosphate as follows:

1.6 grams of refined wood pulp was added to 500 ml of room temperature water and blended for 30 seconds at high speed. 14.4 grams of calcium sodium metaphosphate (Monsanto, St. Louis, Mo.) was added to the above slurry and blended at low speed for one minute. This mixture was poured into 8" by 8" mold having a 100 mesh (U.S.) screen containing 3 liters of warm (50° C.) water. The slurry-containing mold was gravity drained and the sheet was transferred to a conventional flat-bed dryer which had been preset at 200° C. and dried until the moisture content was less than about 1%. This sheet had a thickness of about 1.5 mm, a density of about 0.33 9/cc, and a permeability of about 1000 cm-$sec^{-1}$. The density of this sheet material was reduced by punching a number of 2.5 mm holes. This material was formed into a 10 mm long single layered jacket circumscribing the fuel element. Other jackets were formed by shredding the sheet material in a modified paper shredder and gathering the shredded material around the fuel element.

EXAMPLE IV

Smoking articles similar to those described in Example I were prepared. An 8 gram insulating sheet material was prepared using either calcium sulfate or calcium sodium metaphosphate as follows:

0.8 grams of refined wood pulp was added to 500 ml of room temperature water and blended for one minute at high speed. 6.4 grams of calcium sulfate or calcium sodium metaphosphate was added to the above slurry and blended at low speed for thirty seconds. 0.8 grams of glass beads (O-CELL 500 from P.Q. Corp., Valley Forge, Pa.) were added to the above slurry and poured directly into an 8" by 8" mold having a 100 mesh (U.S.) screen containing 3 liters of warm (50° C.) water and thereafter mixed by gentle stirring. The slurry-containing mold was gravity drained and the sheet was transferred to a conventional flat-bed dryer which had been preset at 200° C. and dried until the moisture content was less than about 2%. This sheet had a thickness of about 0.5 mm, a density of about 0.34 g/cc, and a permeability of about 815 cm-sec$^{-1}$. The density of this sheet material was further reduced by punching a plurality of 2.5 mm holes. This material was formed into a 10 mm long three layered jacket circumscribing the fuel element. Upon lighting of cigarettes employing such sheet materials, the glass beads rupture leaving air pockets which help to insulate the fuel as well as increase the permeability of the sheet material.

EXAMPLE V

Smoking articles similar to those described in Example I were prepared. The insulating sheet material described was sprayed with a 10% aqueous solution of sodium silicate to give a final weight percent of about 1.0. The sprayed sheet material was thereafter dried on a flat-bed dryer as described in Example I and formed into an insulating jacket for the fuel element. This sheet material was found to have improved ash integrity.

EXAMPLE VI

Insulating sheet materials were prepared for the smoking articles described in Example I using vermiculite to provide better tensile strength and mica to provide increased permeability as well as improved tensile strength The sheet material was prepared as in Example I using 4.8 grams of calcium sulfate and 2.4 grams of either vermiculite or mica. The tensile strength of these sheet were 10 lbs./inch for sheets containing vermiculite and 14lbs./inch for the sheets containing mica compared to 4 lbs./inch for sheets without any such additive materials.

EXAMPLE VII

Smoking articles similar to those described in Example I were prepared. Calcium hydroxide was added to the warm water used to disperse the wood pulp in an amount of about 0.5% by weight of the sheet material. The inorganic fibrous material used was the hemihydrate form (a Frnklin Fiber from U.S. Gypsum designated H-45). The retention of the hemihydrate calcium sufate fiber approached 100%. The sheet materials had a density of between 0.20 to 0.25 g/cc.

EXAMPLE VIII

Smoking articles similar to those described in Example I were prepared, except the insulating sheet material was made as follows:

0.8 grams of ¼ inch glass fibers ("C" glass obtained from Owens Corning designated X-5353) were agitated with 250 mls of a 0.003% aqueous solution of Katapol (GAF) in an Osterizer blender at high speed for one minute. About 1.6 grams of refined wood pulp was added to the blender along with a 2% aqueous solution (10 mls) of Methocel (designated A4M from Dow Chemicals). The suspension was agitated in the blender while forcing high pressure air through the suspension. About 13.6 grams of a calcium sulfate fiber (a Franklin Fiber from U.S. Gypsum designated A-45) was added to the foamed suspension of pulp and glass fiber and agitated at low speed for 15-30 seconds. The resulting material was immediately poured into an 8"×8" handsheet mold containing about ½ deep water fitted with a 100 U.S. mesh screen. After thorough mixing, the mold was drained and the sheet transferred to a flat-bed dryer and dried to a moisture content of less than about 2%.

Sheet materials made by this process had a density of between 0.22-0.27 g/cc and excellent tear and tensile strength. The sheet was grooved to a base depth of about 12 mils.

What is claimed is:

1. A smoking article comprising:
(a) a fuel element;
(b) a physically separate aerosol generating means including at least one aerosol forming material; and
(c) an insulating member having a thickness of at least about 0.5 mm, which circumscribes at least a portion of the fuel element, said insulating member comprising an inorganic fibrous material and a fibrillated cellulose-based fiber pulp having a Canadian freeness of less than about 500.

2. The smoking article of claim 1, wherein the inorganic fibrous material is selected from the group of calcium sulfate, calcium sodium phosphate, calcium carbonate, glass fibers, alumina fibers, or mixtures thereof.

3. The smoking article of claim 2, wherein the insulating member includes a dopant.

4. The smoking article of claim 1, wherein the inorganic fibrous material comprises calcium sulfate.

5. The smoking article of claim 1, wherein the inorganic fibrous material comprises calcium sodium phosphate.

6. The smoking article of claim 1, wherein the amount of inorganic fibrous material by weight percent of the insulating member is at least about 55%.

7. The smoking article of claim 1, wherein the amount of inorganic fibrous material by weight percent of the insulating is at least about 70%.

8. The smoking article of claim 1, wherein the amount of inorganic fibrous material by weight percent of the insulating is at least about 90%.

9. The smoking article of claim 4 or 5, wherein the calcium sulfate or calcium sodium phosphate is mixed with another inorganic fibrous material and the amount of the calcium component by weight percent of the insulating member is at least about 30%.

10. The smoking article of claim 8, wherein the amount of the calcium component by weight percent of the insulating member is at least about 45%.

11. The smoking article of claim 9, wherein the amount of the calcium component by weight percent of the insulating member is greater than about 60%.

12. The smoking article of claim 1, wherein the cellulose-based fiber pulp is selected from the group of wood, cotton, hemp, jute, ramie, tobacco, or mixtures thereof.

13. The smoking article of claim 12, wherein the cellulose-based fiber pulp is a softwood pulp.

14. The smoking article of claim 12, wherein the Canadian freeness of the pulp is less than about 300.

15. The smoking article of claim 12, wherein the Canadian freeness of the pulp is less than about 100.

16. The smoking article of claim 12, wherein the amount of cellulose-based fiber pulp by weight percent of the insulating member is less than about 45%.

17. The smoking article of claim 12, wherein the amount of cellulose-based fiber pulp by weight percent of the insulating member is less than about 30%.

18. The smoking article of claim 12, wherein the amount of cellulose-based fiber pulp by weight percent of the insulating member is between about 5 and 20%.

19. The smoking article of claim 1, wherein the insulating member is substantially free of organic binder.

20. The smoking article of claim 1, wherein the insulating member includes an additive material selected from the group of glassy sodium polyphosphates, sodium silicate, sodium carbonate, licorice and non-burnable carbon fibers.

21. The smoking article of claim 20, wherein the amount of additive material by weight percent of the insulating member is between about 10% and 0.1%.

22. The smoking article of claim 20, wherein the amount of additive material by weight percent of the insulating member is between about 5% and 0.5%.

23. The smoking article of claim 20, wherein the amount of additive material by weight percent of the insulating member is between about 2% and 1%.

24. The smoking article of claim 1, wherein the insulating member includes a density reducing component.

25. The smoking article of claim 24, wherein the density reducing component is selected from the group of carbonized fibers, graphite fibers, tobacco components, vermiculite, mica, hollow glass spheres, cork, kapok, cotton, cotton linters, or mixtures thereof.

26. The smoking article of claim 24, wherein the amount of the density reducing component is sufficient to reduce the density of the insulating member to less than about about 0.30 g/cc.

27. The smoking article of claim 24, wherein the amount of the density reducing component is sufficient to reduce the density of the insulating member to less than about 0.25 g/cc.

28. The smoking article of claim 24, wherein the amount of the density reducing component is sufficient to reduce the density of the insulating member to less than about about 0.20 g/cc.

29. The smoking article of claim 1, wherein the insulating member is foamed.

30. The smoking article of claim 1, wherein the thermal conductivity of the insulating member is less than about 0.002 Cal/(sec-cm-°C.).

31. The smoking article of claims 30, wherein the thermal conductivity of the insulating member is less than about 0.001 Cal/(sec-cm-°C.).

32. The smoking article of claims 30, wherein the thermal conductivity of the insulating member is less than about 0.0005 Cal/(sec-cm-°C.).

33. The smoking article of claim 1, wherein the permeability of the insulating member is between about 500 and 5000 cm/sec.

34. The smoking article of claims 33, wherein the permeability of the insulating member is between about 1000 and 3000 cm/sec.

35. The smoking article of claims 33, wherein the permeability of the insulating member is about 2500 cm/sec.

36. The smoking article of claim 1, wherein at least one surface of the insulating member is provided with one or more parallel longitudinal grooves.

37. The smoking article of claim 1, wherein the insulating member comprises at least about 55% by weight of calcium sulfate fibers or calcium sodium phosphate fibers and is substantially free of organic binder.

38. The smoking article of claim 37, wherein the density of the insulating member is less than about 0.25 g/cc.

39. The smoking article of claim 37, wherein the Canadian freeness of the cellulose-based fiber pulp is less than about 200.

40. A smoking article comprising:

(a) a fuel element;

(b) a physically separate aerosol generating means including at least one aerosol forming material; and (c) an insulating member which circumscribes at least a portion of the fuel element, comprising at least about 55% by weight of calcium sulfate fibers or calcium sodium phosphate fibers, less than about 30% by weight of a fibrillated cellulose-based fiber pulp having a Canadian freeness of less than about 500, and at least about 5% by weight of carbonized fibers.

41. The smoking article of claim 40, wherein the insulating member is substantially free of organic binder.

42. The smoking article of claim 40 or 41, wherein the Canadian freeness of the cellulose-based fiber pulp is less than about 200.

43. The smoking article of claim 40 or 41, wherein the density of the insulating member is less than about 0.25 g/cc.

44. A smoking article comprising:

(a) a fuel element;

(b) a physically separate aerosol generating means including at least one aerosol forming material;

(c) separate means for providing the aerosol produced by the aerosol generating means to the smoker and;

(d) a fibrous material which circumscribes at least a portion of the fuel element, comprising refined wood pulp and calcium sulfate fibers or calcium sodium phosphate fibers.

45. The smoking article of claim 44, wherein the fibrous material is located within the aerosol generating means.

46. The smoking article of claim 44, wherein the fibrous material is located within the separate delivery means.

47. The smoking article of claim 44, wherein at least a portion of the aerosol generating means is circumscribed by the fibrous material.

48. The smoking article of claim 44, wherein the fibrous material is a wrapper for one or more components of the smoking article.

49. The smoking article of claim 1, 40 or 44, wherein the fuel element is carbonaceous.

50. The smoking article of claim 1, 40 or 44, wherein the fuel element is less than about 30 mm in length prior to smoking.

51. The smoking articles of claims 1, 2, 4, 5, 6, 7 or 8, wherein the number average fiber length of the inorganic fibrous material is less than about 1 mm.

52. The smoking articles of claims 1, 2, 4, 5, 6, 7 or 8, wherein the number average fiber length of the inorganic fibrous material is less than about 500μ.

53. The smoking articles of claims 1, 2, 4, 5, 6, 7 or 8 wherein the number average fiber length of the inorganic fibrous material is less than about 250μ.

54. The smoking article of claim 3, wherein the inorganic fibrous material comprises calcium sulfate and the dopant is selected from the group of calcium hydroxide, calcium acetate, calcium carbonate, calcium sulfate, sodium alginate, magnesium carbonate, dolomite, or mixtures thereof.

55. The smoking articles of claims 40, 41, 44, 45, 46, 47 or 48, wherein the number average fiber length of the calcium sulfate fibers or calcium sodium fibers is less than about 1 mm.

56. The smoking articles of claims 40, 41, 44, 45, 46, 47 or 48, wherein the number average fiber length of the calcium sulfate fibers or calcium sodium fibers is less than about 500$\mu$.

* * * * *